US005634846A

United States Patent [19]

Lee et al.

[11] Patent Number: 5,634,846

[45] Date of Patent: Jun. 3, 1997

[54] OBJECT DETECTOR FOR AIR CONDITIONER

[75] Inventors: Sung-soo Lee, Suwon; Tae-ho Kim, Ansan; Won-kyo Jung, Suwon, all of Rep. of Korea

[73] Assignee: Samsung Electronics Co., Ltd., Kyungki-do, Rep. of Korea

[21] Appl. No.: 636,587

[22] Filed: Apr. 23, 1996

[30] Foreign Application Priority Data

Apr. 25, 1995 [KR] Rep. of Korea ..... 95-9801

[51] Int. Cl.[6] ..... G08B 13/18

[52] U.S. Cl. ..... 454/256; 165/237; 250/221; 340/567

[58] Field of Search ..... 454/256, 313, 454/314, 315, 338; 340/567, 555; 250/221, 353, 342, 349; 165/16

[56] References Cited

U.S. PATENT DOCUMENTS 4,671,458 6/1987 Fukuda et al. ..... 165/16 X 4,849,737 7/1989 Kirihata et al. ..... 340/567

5,221,919 6/1993 Hermans ..... 340/567

FOREIGN PATENT DOCUMENTS 2-196931 8/1990 Japan ..... 340/567

*Primary Examiner*—Harold Joyce

*Attorney, Agent, or Firm*—Burns, Doane, Swecker & Mathis, LLP

[57] ABSTRACT

An object detector for an air conditioner has a signal detection input unit in which a light block is provided between a pair of Fresnel lenses spaced in parallel by a predetermined distance on a printed circuit board, thereby defining substantially three detection areas. The signal detection input unit detects the number, locations and movement distance of persons present indoor from a received signal, and outputs a signal representative of the information. Then, a command for the operation of an air conditioner is issued according to the information signal, thereby enabling the optimum operation of the air conditioner under circumstances.

12 Claims, 4 Drawing Sheets

OBJECT DETECTOR FOR AIR CONDITIONER

BACKGROUND OF THE INVENTION

The present invention relates to an object detector employing a superconductive device, and more particularly, to an object detector for an air conditioner which detects the information of the number, locations, and movement of persons in a plurality of detection areas, and outputs a control signal based on the information.

An infrared object detector employing a superconductive device finds its general use in a burglar alarm device or in a device for automatically opening and shutting a door. Recently, studies have been actively conducted on applications of the infrared object detector to an air conditioner or a camera, to more accurately detect the distance to an object such as a person, its location and movement.

FIG. 1 illustrates an example of a conventional infrared detector applied to an air conditioner. This infrared detector detects the information of a person present indoor, and controls the output of the air conditioner for an adequate cooling according to the information.

Referring to FIG. 1, the conventional object detector for an air conditioner has a cover member 12 covering a printed circuit board (PCB) 11 to form a predetermined space therebetween. A pair of superconductive devices 13 and 13' of a thin film type are spaced in parallel by a predetermined distance inside the space. Light incident apertures 14 and 14' are formed at the cover member 12 to correspond to the superconductive detecting devices 13 and 13', respectively. A blocking plate 15 is provided inside the cover member 12, facing between the superconductive devices 13 and 13'. In addition, the superconductive devices 13 and 13' are sequentially connected to their respective amplifiers 16 and 16', window comparators 17 and 17', and timers 18 and 18', thereby constituting a circuit for processing a signal.

In the conventional object detector for an air conditioner as constituted above, when a person indoor moves from a view A to a view B, as shown in FIG. 1, polarization takes place with a time interval between the superconductive detecting devices 13 and 13', and signals are output from impedance transform devices (not shown). The output signals are amplified in the amplifiers 16 and 16', and the amplified signals are converted into square wave signals by high and low level reference voltages in the window comparators 17 and 17' Timers 18 and 18', which are provided for precluding impacts of ambient changes, ignores the later one of the output signals for a predetermined time by the earlier one of the output signals, to thereby prevent a malfunction.

This conventional object detector for an air conditioner exhibits its limitations in achieving the comprehensive information of persons present indoor, including number, location and movement distance, since its detective operations are confined to their movement directions. Therefore, it is impossible to control an air conditioner to operate in an optimum state.

SUMMARY OF THE INVENTION

To overcome the above limitations of the conventional object detector for an air conditioner and improve it, the object of the present invention is to provide an object detector for an air conditioner which is capable of detecting the information of the number, locations, and movement distance of persons from a plurality of detection areas, and outputting a control signal based on the information.

To achieve the above object, there is provided an object detector for an air conditioner comprising signal detection input means having a pair of Fresnel lenses spaced in parallel by a predetermined distance on a printed circuit board, and light blocking means between the Fresnel lenses, so that substantially three signal detection areas are defined, signal processing circuit having superconductive devices, amplifiers, and window comparators sequentially connected to the respective Fresnel lenses, and a logic calculator connected to the window comparators, to classify a signal detected through the signal detection input means into a signal waveform for each of the signal detection areas, and a microcomputer for receiving the signal waveform from the signal processing circuit and outputting a command signal for controlling the operation of the air conditioner.

Preferably, the Flesnel lenses have hemispherical light incident surfaces, respectively, and the light blocking means is one of a light blocking tape and a partial mask. It is also preferable that the logic calculator comprises a NAND gate, classifying signals output from two signal processing circuits into a signal waveform for each signal detection area to determine the signal detection area, and outputting a signal indicative of the determined signal detection area. The microcomputer outputs an operational command signal for controlling operational levels of a rotational fan and a louver in the air conditioner according to the signal output from the logic calculator. The microcomputer outputs a command signal for controlling a vertical louver and a horizontal louver of the air conditioner in three and six levels, respectively, according to the signal output from the logic calculator, to thereby controlling the rotational angles of the louvers.

It is desirable that the signal detection input means comprises a cover member the pair of Fresnel lenses on the printed circuit board, a plurality of groups of LED displays being provided under the cover member to visually display the information of a command signal for the operation of the air conditioner according to each signal detection area. The LED displays are grouped into three.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

An object detector for an air conditioner according to a preferred embodiment of the present invention will be described in detail.

Figure 1:
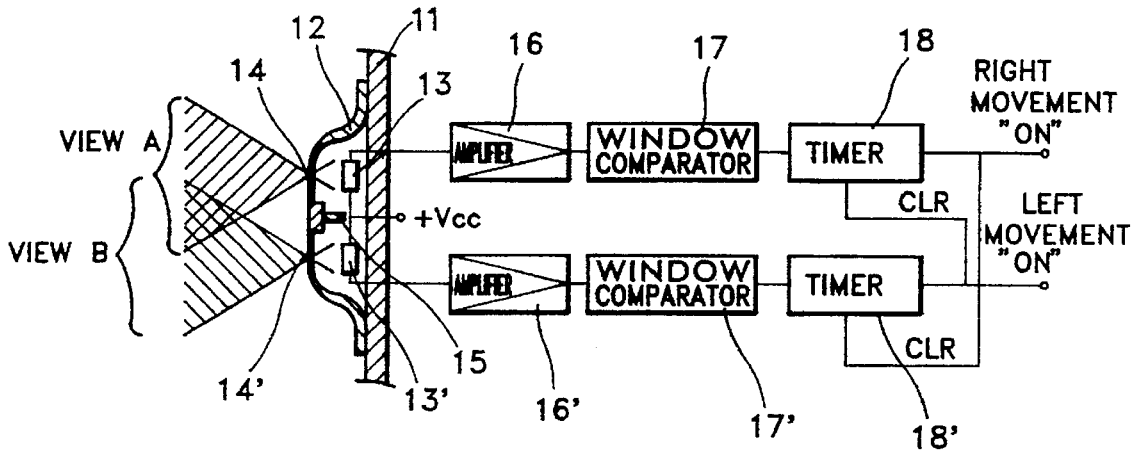
FIG. 1 (PRIOR ART)
FIG. 1 is a schematic view of a conventional object detector for an air conditioner.
Figure 2:
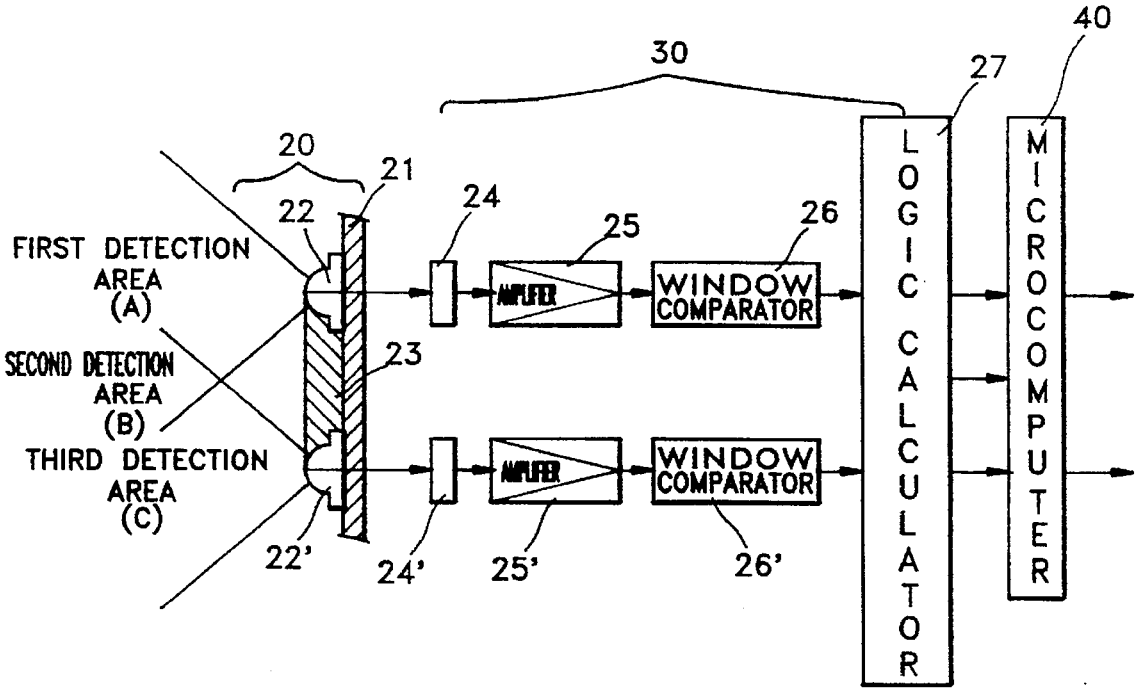
FIG. 2 is a schematic view of an object detector for an air conditioner according to the present invention.

Referring to FIG. 2, the object detector for an air conditioner according to the present invention is comprised of a signal detection input unit 20, a signal processing circuit unit 30, and a microcomputer 40.

The signal detection input unit 20 has a pair of Fresnel lenses 22 and 22' spaced in parallel by a predetermined distance on a PCB 21 and having their respective light incident hemispherical surfaces. A partial mask or a light blocking tape as light blocking means 23 is attached between the Fresnel lenses 22 and 22'. Each of the Fresnel lenses 22 and 22' has a chip including a superconductive devices 24 or 24' built therein.

The hemispherical light incident surfaces of the Fresnel lenses 22 and 22' ensures a predetermined light incident angle, thus defining a plurality of detection areas, i.e., first, second, and third detection areas A, B and C.

Figure 3:
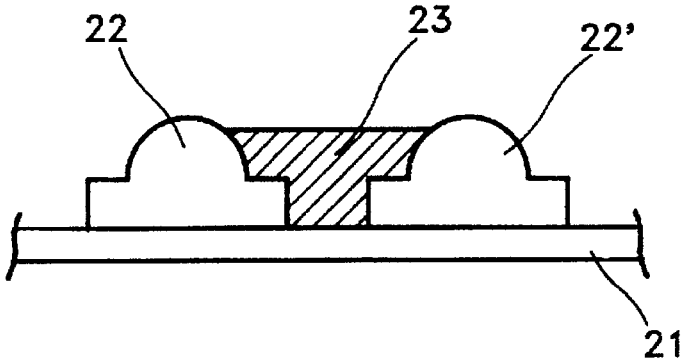
FIG. 3 is a schematic sectional view of an embodiment of the Fresnel lens portion in the object detector for an air conditioner shown in FIG. 2.
Figure 4:
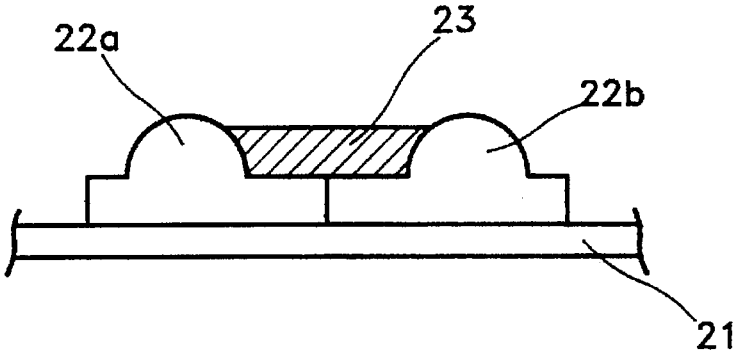
FIG. 4 is a schematic sectional view of another embodiment of the Fresnel lens portion in the object detector for an air conditioner shown in FIG. 2.
Figure 5:
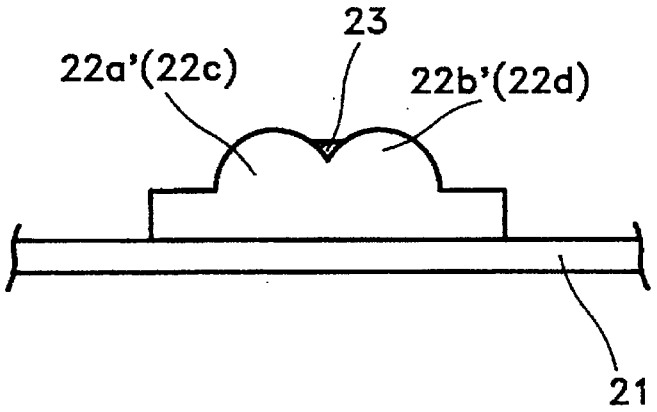
FIG. 5 is a schematic sectional view of still another embodiment of the Fresnel lens portion in the object detector for an air conditioner according to the present invention.

The plurality of detection areas can be more precisely discriminated by adjusting the distance between lenses in a plurality of, preferably, two hemispherical Fresnel lenses or a multi-lens array according to the proximity or distantness of the detection areas, as shown in FIGS. 3 to 5.

The signal processing circuit unit 30 includes amplifiers 25 and 25' and window comparators 26 and 26', which are sequentially coupled to the superconductive detecting devices 24 and 24', respectively. The window comparators 26 and 26' are coupled to a logic calculator 27 having logic ICs, thereby constituting a circuit for processing a signal on the PCB 21. The logic calculator 27 is comprised of a NAND gate, and classifies signals output from two circuits into pulses indicative of detection areas to output each pulse from each detection area to the microcomputer The microcomputer 40 outputs a command signal for controlling the operation of an air conditioner, for example, a command signal for controlling the rotation of a fan or the operation of a louver, according to the pulse waveform received from the logic calculator 27.

Figure 6:
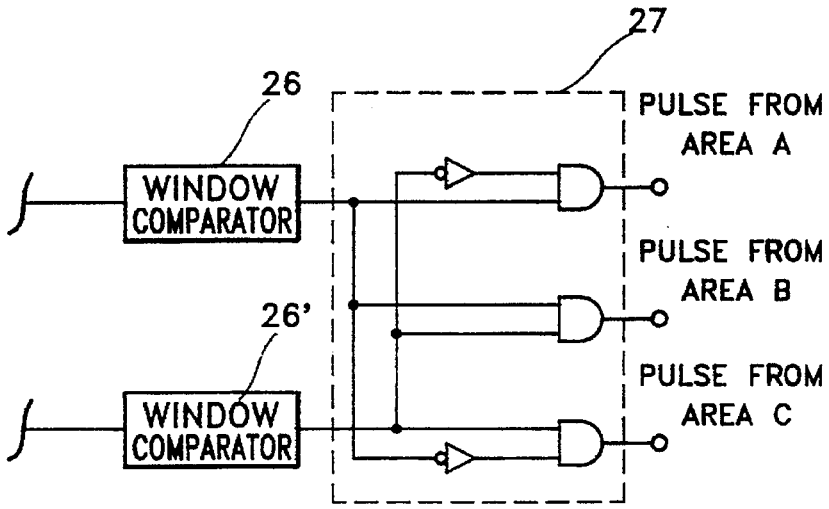
FIG. 6 shows an algorithm for discriminating detection areas in a logic calculator of the object detector for an air conditioner according to the present invention.

In the object detector for an air conditioner according to the present invention as constituted above, when a person is present in one of the detection areas, e.g., the first detection area A in this embodiment, charges are generated in the superconductive detecting device 24 so that a voltage is formed at the gate of the impedance transform device, thereby generating an electric signal. Signal components excluding a signal component of a predetermined frequency band are removed from this signal, and only the signal component of the frequency band is amplified and output to the window comparator 26. The amplified signal received by the window comparator 26 is A–D converted into a square wave signal of a predetermined band width and output to the logic calculator 27. Referring to FIG. 6, the logic calculating unit 27 determines through the logic ICs from which detection area of the first, second, and third detection areas A, B and C the input signal waveform was generated, and outputs a signal indicative of the determined detection area to the microcomputer 40.

Figure 7:
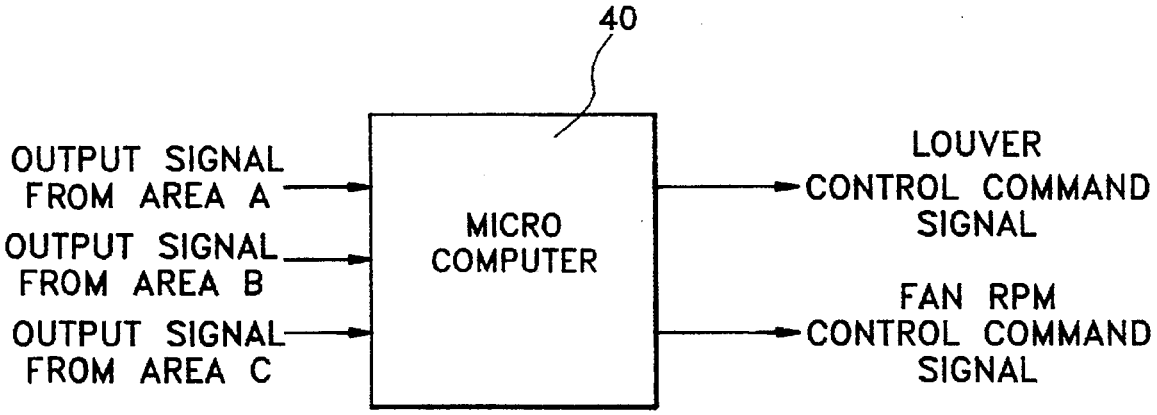
FIG. 7 shows a connection relationship between the air conditioner and signals output from the object detector for an air conditioner according to the present invention.

Referring to FIG. 7, the microcomputer 40 determines how many persons are present in the detection area by processing the received signal, and outputs an operational command signal for properly operating the air conditioner according to the determination, on the basis of predetermined several levels of functions. For instance, a vertical louver and a horizontal louver are adjusted to have six levels and three levels, respectively, according to the signal determination result of the microcomputer 40, thereby controlling their rotational angles. The airflow is adequately controlled depending on the number, locations, and movement distance of persons by setting the rotational speed of a fan, for example, to three levels.

Meantime, the Fresnel lenses 22 and 22' in the object detector for an air conditioner may be modified, as shown in FIGS. 4 and 5. That is, a partial mask or a light blocking tape 23 as light blocking means may be attached to the hemispherical light incident portions of the pair of Fresnel lenses **22*a* and 22*b* in contact with each other. In addition, a substantially single light receiving lens unit can be made out by combining a 2×2 matrix superconductive detecting device with four Fresnel lenses 22*a'*, 22*b'*, 22*c* and 22*d***.

The range of a signal detection area and an operational command signal for an air conditioner can be adjusted more precisely by modifying the structure of the Fresnel lenses as in the above embodiments.

Figure 8A:
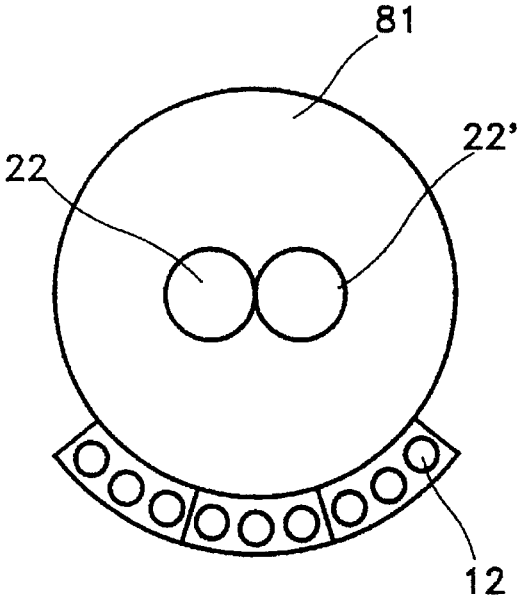
FIGS. 8A and 8B are front and side views of a signal detection input unit having an light emitting diode (LED) displays, respectively, in the object detector for an air conditioner according to the present invention.
Figure 8B:
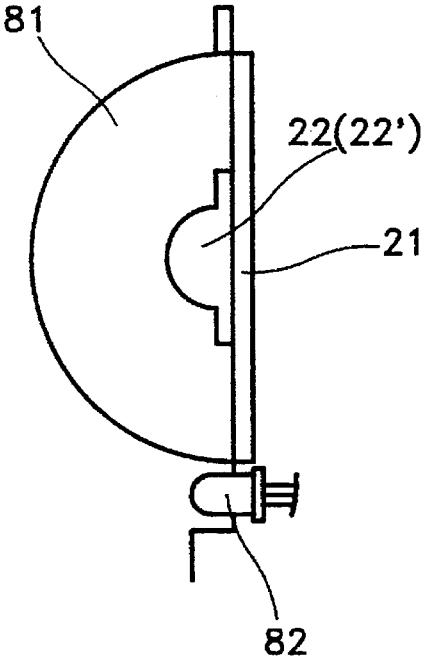

FIGS. 8A and 8B illustrate the signal detection input unit 20 according to another embodiment in the object detector for an air conditioner of the present invention.

According to the embodiment of FIGS. 8A and 8B, a cover member 81 is combined with a PCB 21 having a pair of Fresnel lenses 22 and 22' arranged thereon. Under the cover member 81 are formed plural groups of LED displays 82, three groups of LED displays in this embodiment.

The LED displays 82 function to visually display the information of a determination signal, which is used to issue an operational command of the air conditioner according to the number and movement distance of persons. For instance, if a final detection information signal is output from the microcomputer 40, one, two or three of the three groups of LED displays 82 turn on according to the information signal. Here, the standards for turning on the LED displays can correspond to those of determining the number and movement distance of persons, if the number and movement distance are classified into three levels. Further, scanning each detection area can be displayed by sequentially turning on the whole LEDs.

As described above, the object detector for an air conditioner according to the present invention has the signal detection input unit in which light blocking means is provided between the pair of Fresnel lenses spaced in parallel by a predetermined distance on the PCB, thereby defining substantially three detection areas. The signal detection input unit detects the number, locations and movement distance of persons present indoor from a received signal, and outputs a signal representative of the information. Then, a command for the operation of the air conditioner is issued according to the information signal, thereby enabling the optimum operation of the air conditioner under circumstances.

What is claimed is:

1. An object detector for an air conditioner comprising:

signal detection input means having a pair of Fresnel lenses spaced in parallel by a predetermined distance on a printed circuit board, and light blocking means between said Fresnel lenses, so that substantially three signal detection areas are defined;

signal processing circuit having superconductive devices, amplifiers, and window comparators sequentially connected to said respective Fresnel lenses, and a logic calculator connected to said window comparators, to classify a signal detected through said signal detection input means into a signal waveform for each of said signal detection areas; and a microcomputer for receiving said signal waveform from said signal processing circuit and outputting a command signal for controlling the operation of said air conditioner.

2. An object detector for an air conditioner as claimed in claim 1, wherein said Flesnel lenses have hemispherical light incident surfaces, respectively, and contact each other.

3. An object detector for an air conditioner as claimed in claim 1, wherein said signal detection input means comprises a substantially single light receiving lens formed by combining 2×2 matrix superconductive devices with four Fresnel lenses.

4. An object detector for an air conditioner as claimed in claim 1, wherein said light blocking means is one of a light blocking tape and a partial mask.

5. An object detector for an air conditioner as claimed in claim 1, wherein said logic calculator comprises a NAND gate, classifying signals output from two signal processing circuits into a signal waveform for each signal detection area to determine said signal detection area, and outputting a signal indicative of said determined signal detection area.

6. An object detector for an air conditioner as claimed in claim 1, wherein said microcomputer outputs an operational command signal for controlling operational levels of a rotational fan and a louver in said air conditioner according to said signal output from said logic calculator.

7. An object detector for an air conditioner as claimed in claim 1, wherein said microcomputer outputs a command signal for controlling a vertical louver and a horizontal louver of said air conditioner in three and six levels, respectively, according to said signal output from said logic calculator, to thereby controlling the rotational angles of said louvers.

8. An object detector for an air conditioner as claimed in claim 6, wherein said microcomputer outputs a command signal for controlling a vertical louver and a horizontal louver of said air conditioner in three and six levels, respectively, according to said signal output from said logic calculator, to thereby controlling the rotational angles of said louvers.

9. An object detector for an air conditioner as claimed in claim 1, wherein said microcomputer outputs a command signal for controlling the rotational speed of a fan of said air conditioner in three levels, according to said signal output from said logic calculator, to thereby controlling air flow in consideration of the number and movement distance of persons.

10. An object detector for an air conditioner as claimed in claim 6, wherein said microcomputer outputs a command signal for controlling the rotational speed of a fan of said air conditioner in three levels, according to said signal output from said logic calculator, to thereby controlling air flow in consideration of the number and movement distance of persons.

11. An object detector for an air conditioner as claimed in claim 1, wherein said signal detection input means comprises a cover member the pair of Fresnel lenses on said printed circuit board, a plurality of groups of LED displays being provided under said cover member to visually display the information of a command signal for the operation of said air conditioner according to each signal detection area.

12. An object detector for an air conditioner as claimed in claim 11, wherein said LED displays are grouped into three, each group having three LED displays, to display in three levels the information of said command signal for the operation of said air conditioner according to each signal detection area.

* * * * *